US005823420A

United States Patent [19]

Tokarski et al.

[11] Patent Number: 5,823,420

[45] Date of Patent: *Oct. 20, 1998

[54] PUSH-TAB HINGE FOR A CONTAINER CLOSURE APPARATUS

[75] Inventors: Michael G. Tokarski, Dublin, Ohio; C. Daniel Miller, Rockford, Ill.; Arthur W. Robichaud, West Worthington, Ohio

[73] Assignee: Combibloc, Inc., Columbus, Ohio

[ * ] Notice: The term of this patent shall not extend beyond the expiration date of Pat. No. 5,639,018.

[21] Appl. No.: 792,926

[22] Filed: Jan. 21, 1997

Related U.S. Application Data

[63] Continuation of Ser. No. 521,745, Aug. 31, 1995, Pat. No. 5,639,018.

[51] Int. Cl.[6] ..... B65O 5/74

[52] U.S. Cl. ..... 229/125.04; 220/254; 220/339; 229/125.14; 229/125.15

[58] Field of Search ..... 229/125.14, 125.15, 229/930, 125.04, 125.09, 931; 220/254, 339, 256, 258, 366.1, 367.1

[56] References Cited

U.S. PATENT DOCUMENTS

| | | | |
|---|---|---|---|
| 3,526,566 | 9/1970 | McIlvain et al. | 229/930 |
| 3,629,901 | 12/1971 | Wolf et al. | 229/930 |
| 3,998,354 | 12/1976 | Song | 220/254 |
| 4,778,071 | 10/1988 | Fillmore | 220/339 |
| 4,930,683 | 6/1990 | Farber | 229/125.15 |
| 5,016,777 | 5/1991 | Marvin | 220/339 |
| 5,101,999 | 4/1992 | Robichaud et al. | 229/125.14 |
| 5,126,093 | 6/1992 | Gelardi et al. | 220/339 |

FOREIGN PATENT DOCUMENTS

| | | | |
|---|---|---|---|
| 577865 | 1/1994 | European Pat. Off. | 229/125.15 |
| 242753 | 9/1990 | Japan | 220/339 |

*Primary Examiner*—Gary E. Elkins
*Attorney, Agent, or Firm*—Standley & Gilcrest

[57] ABSTRACT

A package closure apparatus is disclosed which has a push-tab connected to a base via a landing which extends into a central opening in said closure and a spring face which extends from said push-tab to connect with the landing. The connection between the landing and spring face forms a first junction about which the hinge may act. The connection between the spring face and the push-tab forms a second junction about which the hinge may act.

9 Claims, 3 Drawing Sheets

PUSH-TAB HINGE FOR A CONTAINER CLOSURE APPARATUS

This application is a continuation of application Ser. No. 08/521,745 filed Aug. 31, 1995 now U.S. Pat. No. 5,639,018.

BACKGROUND AND SUMMARY OF THE INVENTION

The present invention relates generally to containers useful for products that may be poured from the container and, more particularly, to improved closures secured to said containers. For example, paperboard cartons are generally well known. A familiar type is the milk carton which has a gabled top. Also, becoming ever more popular are rectangular shaped cartons, some of aseptic quality, for containing beverages, powdered goods, and practically any other pourable substance. To prevent waste and provide for ease of pouring, improved pour-through closure apparatus for securing openings in said containers are needed. Practically any container to be used to hold pourable contents may benefit from the improved closure of the present invention.

Push-tabs have been used in combination with container closure apparatus, which are designed to be depressed into the material of the container or package. The push-tabs serve to open a partially pre-cut area on the surface of the package below the closure. The push-tab separates the material of the package and may serve to hold the material apart to maintain the opening during pouring.

Previous closure push-tabs have been hinged directly to an inner wall that defined a central opening in the closure apparatus. The present invention recognizes a need for improved force distribution through the hinge, when the push-tab is depressed by a user of the container. By improving the push-tab hinge design, stress distribution through the hinge is improved. As a result of the hinge design improvements, the closure apparatus may be manufactured from a broader range of materials, some of which may be less expensive.

The present invention provides a push-tab hinge which distributes stresses more effectively than previous hinge designs. In particular, the present invention provides a landing which extends from the closure central opening to a spring face which depends from the push-tab. The junction between the landing and the spring face provides a first flexible joint through which the hinge acts. The junction between the spring face and the push-tab provides a second flexible joint through which the hinge acts. Furthermore, the spring face may be flexible through its entire length, thereby providing additional means by which the hinge may flex as the push-tab is depressed.

The entire apparatus may be made as a one-piece injection molded plastic unit, having movable parts. Reference is made to U.S. Pat. No. 5,101,999, which is hereby incorporated by reference into the present application.

These and other advantages will be apparent from the following detailed description of the invention, drawings, and claims.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENT(S)

Figure 1:
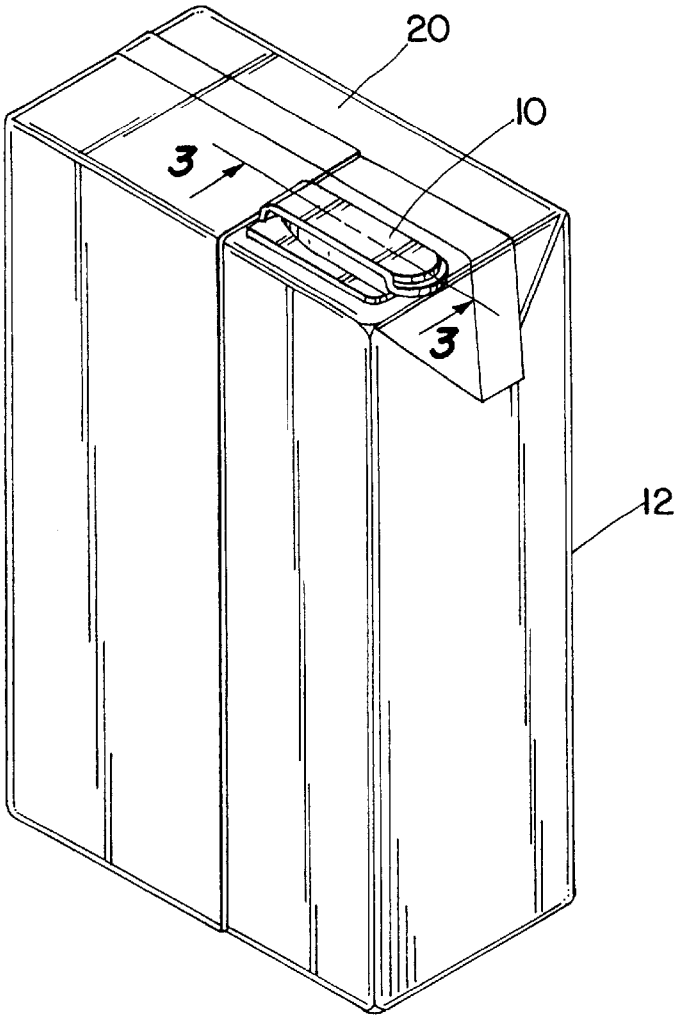
FIG. 1 is a perspective view of one embodiment of the closure apparatus of the present invention attached to the top of a package or container.

Referring to FIG. 1, a closure apparatus 10 for opening and resealing a package 12 is shown. The package 12 may be made from a penetrable material, and may contain a dispensable fluid, powder, particulate solid substance, or any other pourable contents.

Figure 2:
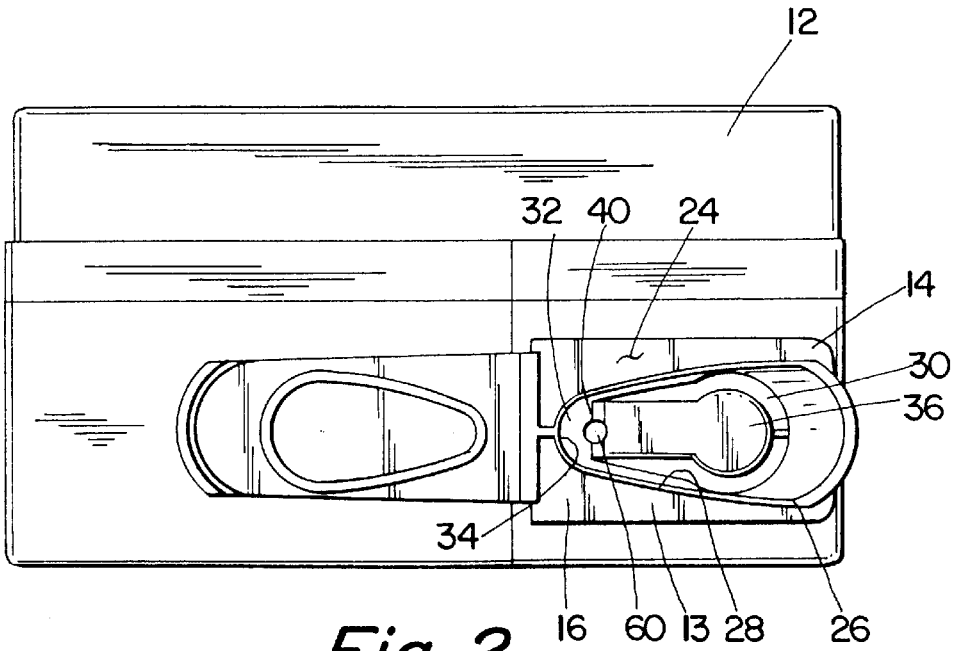
FIG. 2 is a plan view of the closure apparatus of FIG. 1 with a cover rotated to its open position.
Figure 3:
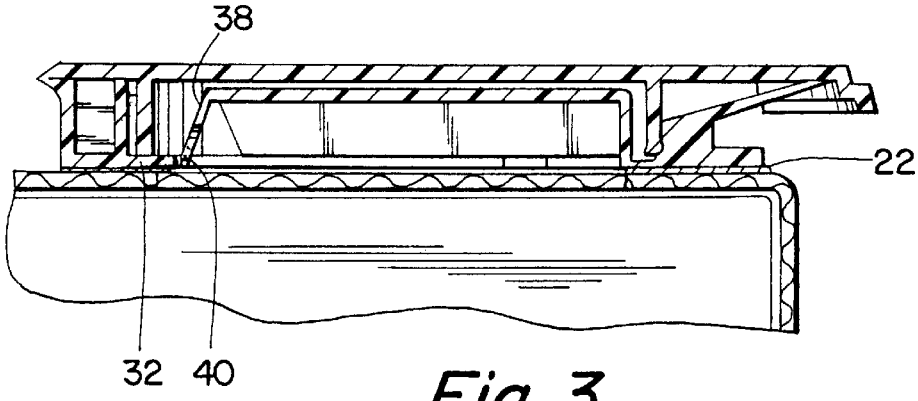
FIG. 3 is an enlarged section view taken along line 3—3 in FIG. 1.
Figure 5:
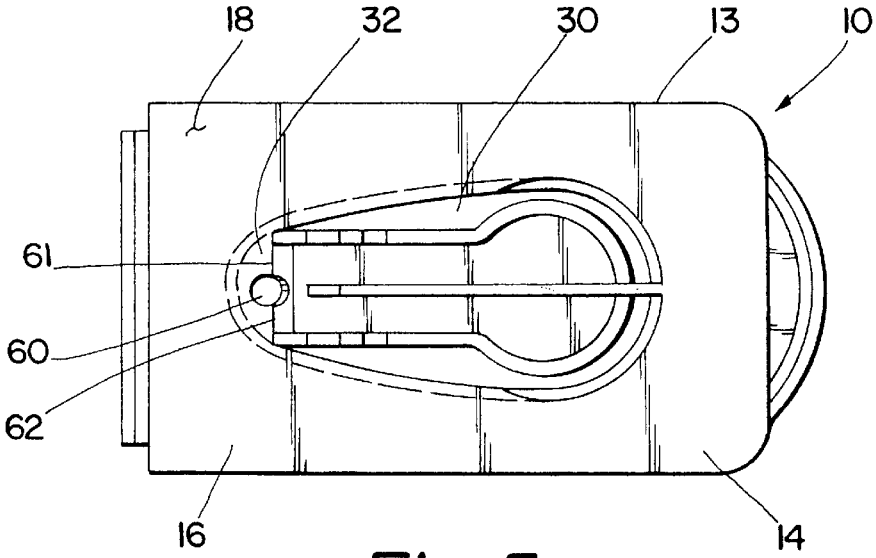
FIG. 5 is a plan view showing the bottom surface of a preferred embodiment of the closure apparatus of the present invention.

As shown in FIG. 2, the closure apparatus 10 may have a base 13 having a forward portion 14 and a rearward portion 16. The bottom surface 18 of the base 13 (as shown in FIG. 5) may be attached to the package top 20 by any suitable means, such as an adhesive 22 applied to the bottom surface 18. The closure apparatus is shown secured to the package 12 in FIG. 3.

On a top surface 24 of the base 13 there may be a formed pour wall 26. Interiorally of the pour wall 26 there may be formed an inner side wall 28 that defines a central opening 30. In the preferred embodiment, a landing 32 extends from the rear portion 34 of the inner side wall 28. It is to be recognized that the landing 32 may extend from elsewhere, such as from pour wall 26, on the apparatus 10 and remain within the scope of the present invention. The present invention may also be accomplished without a landing.

Figure 6:
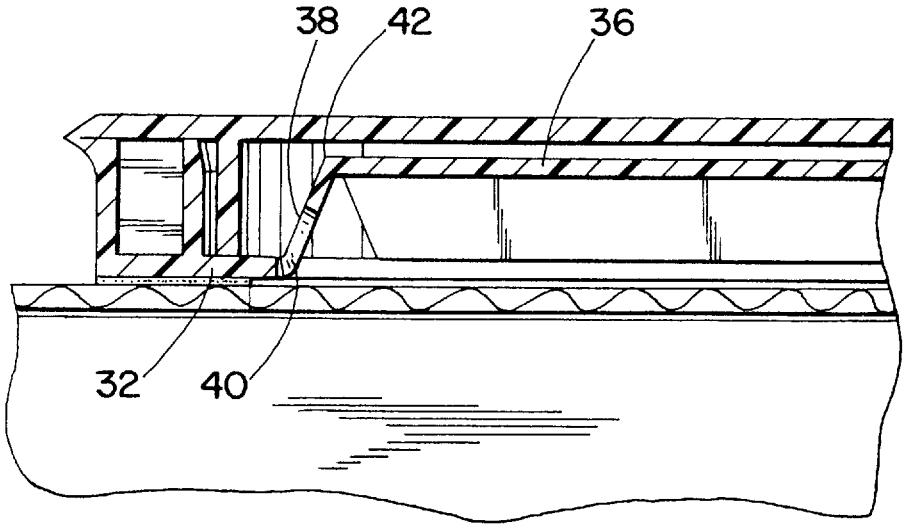
FIG. 6 is a detail view of the hinge of FIG. 3.

A push-tab 36 is formed to initially reside within the inner side wall 28 directly over the central opening 30. The push-tab 36 has a spring face (best shown in FIG. 3) extending from the push-tab 36. The spring face 38 is also integrally connected with the landing 32. The junction 40 between the spring face 38 and the landing 32 forms a first flexible joint. The junction 42 between the spring face 38 and the push-tab 36 forms a second flexible joint. Both flexible joints 40, 42 may be seen best in FIG. 6. The spring plate 38 and the first and second junctions 40 and 42 in combination with the landing 32 provides a robust hinge which distributes stress more effectively than previous designs.

The spring face 38 may, in another embodiment of the present invention, extend directly from the inner side wall 28. In this case, the first junction 40 would reside at the location where the side wall 28 and the spring face 38 meet.

Figure 4:
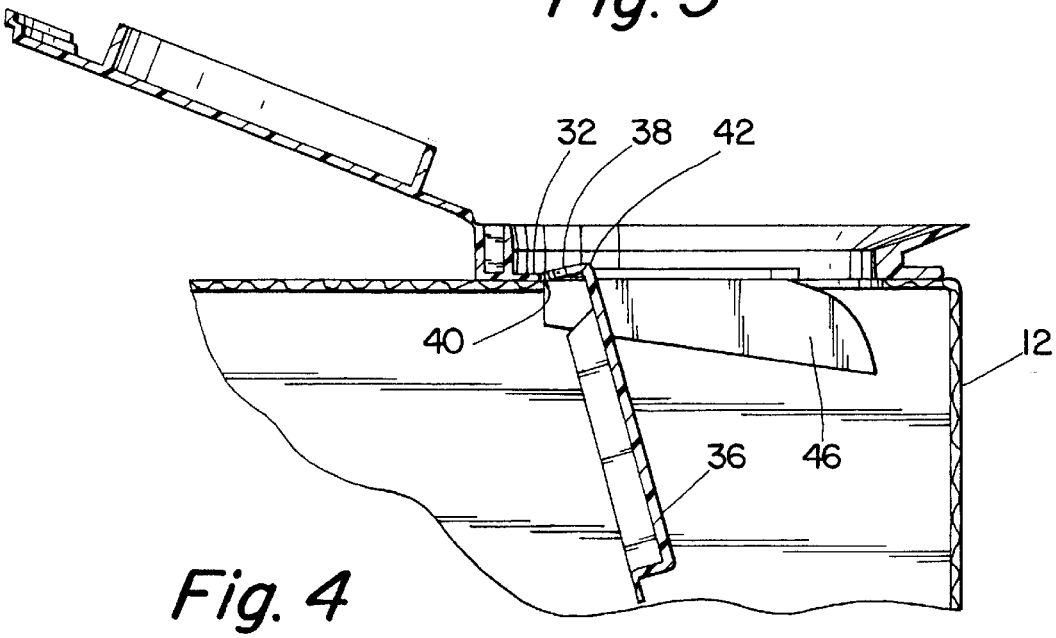
FIG. 4 is a cut away, side elevational view showing the push-tab in its open position and material of the package top broken into the package.

Referring to FIG. 4, the push-tab 36 is shown in its depressed position, having broken through the material 46 of the package 12. As the push-tab 36 is depressed, junctions 40 and 42 are placed in flexion, as is spring face 38.

The closure apparatus 10 may be provided with a vent hole 60 to allow air to enter and exit the package when the contents are poured from the package 12. The vent hole 60 allows for a more even flow rate of the contents out of the package. Vent hole 60 may be provided in several places, including spring plate 38, in landing 32, or the vent hole 60 may straddle the junction 40.

Referring to FIG. 5, if the vent hole 60 is supplied where shown, in the center of junction 40, it effectively divides the junction into two halves. The two halves 61, 62 act as hinge straps. The dual hinge strap embodiment results in practically having two hinges (61 and 62) in place of one continuous junction hinge 40.

The present invention has been described in the form of preferred embodiments, but it is to be recognized that several modifications and variations to the invention could be made and fall within the scope of the subjoined claims.

What is claimed is:

1. A push-tab opening device for use on a package having pourable contents comprising:

a base having a central opening;

a push-tab hinged to said base, such that said push-tab is depressable into said package creating an opening in said package directly beneath said central opening, said push-tab operable through a first flexible joint, a spring face, and a second flexible joint, together forming a hinge enabling said push-tab to pivot about said base.

2. The push-tab device of claim 1, wherein said push-tab is formed from one-piece of material integral with said base.

3. The push-tab device of claim 1 further comprising a cover pivotally connected to said base, said cover adapted to fit over said central opening.

4. The push-tab device of claim 1 further comprising an air vent for facilitating a substantially even flow rate.

5. The push-tab device of claim 4 wherein said air vent is located in said spring face.

6. The push-tab device of claim 4 wherein said air vent is located in said push-tab.

7. The push-tab device of claim 4 wherein said air vent is located in said first flexible joint and divides said first flexible joint into two strap hinges.

8. The push-tab device of claim 4 wherein said air vent is located in said second flexible joint and divides said second flexible joint into two strap hinges.

9. The push-tab device of claim 1 further comprising a spout formed on said base at a pouring edge.

* * * * *